United States Patent [19]

Bodega

[11] 4,441,354

[45] Apr. 10, 1984

[54] PROCESS FOR MANUFACTURING THIN UNITARY HOLLOW METAL BODIES

[75] Inventor: Sergio Bodega, Abbadia Lariana, Italy

[73] Assignee: Tubettificio Ligure S.p.A., Abbadia Lariana, Italy

[21] Appl. No.: 314,048

[22] Filed: Oct. 22, 1981

[30] Foreign Application Priority Data

Nov. 28, 1980 [IT] Italy ..... 26290 A/80

[51] Int. Cl.[3] ..... B21B 22/00

[52] U.S. Cl. ..... 72/342; 72/349; 72/364

[58] Field of Search ..... 72/347–349, 72/342, 364; 413/1, 69

[56] References Cited

U.S. PATENT DOCUMENTS 3,811,306 5/1974 Yoshimura .
3,964,412 6/1976 Kitsuda .
3,986,382 10/1976 Miller et al. ..... 72/349
3,995,572 12/1976 Saunders .
4,173,883 11/1979 Boik ..... 413/1 X
4,220,106 9/1980 Supik ..... 413/1

FOREIGN PATENT DOCUMENTS 1075665 7/1967 United Kingdom .

*Primary Examiner*—Leon Gilden
*Attorney, Agent, or Firm*—Karl F. Ross; Herbert Dubno

[57] ABSTRACT

A process for forming hollow bodies of metal materials, particularly of aluminum alloys, based on a suitable combination of mechanical operations comprising deep drawing, stretching, tapering and tool machining, whereby it is possible to obtain essentially cylindrical one-piece metal bodies with a concave dished bottom and a dome-shaped head provided with a beaded opening. The unitary bodies are characterized in that the cylinder walls are very thin, highly strain-hardened and endowed with high mechanical properties, permitting a remarkable reduction in the metal material amount used in the aforesaid enbloc bodies, destined for being used chiefly as pressure containers, for example for aerosol.

3 Claims, 6 Drawing Figures

PROCESS FOR MANUFACTURING THIN UNITARY HOLLOW METAL BODIES

FIELD OF THE INVENTION

This invention relates to a process for manufacturing thin wall unitary hollow metal bodies, particularly useful as pressure containers.

BACKGROUND OF THE INVENTION

Particularly in the last years the manufacturers of metal containers have directed great attention to the problem of the relevant cost reduction, and since the cost of a container is formed for approx. 50% by the cost of the material, it is clear that the efforts aiming at containing the total cost are chiefly directed to a reduction of the amount of metal utilized, usually by reducing the thickness of the container cylindrical wall in which most of the metal resides.

These efforts, however, cannot easily find a satisfactory solution because the walls, besides resistance internal operating pressures, must also have a proper resistance to the external mechanical stresses during the various utilization steps, such as transport, filling, closing and various further handling operations.

Another problem connected with the manufacture of such containers with metal materials which, to desired high mechanical characteristics are of difficult workability, is that of obtaining same, especially as they are destined to uses involving high internal operating pressures, in the form of one-piece bodies without joints and welds, with only a narrow opening in the head—usually of a hemispherical or ogival shape to—for the application of the closing and delivery valve. this type of container offers, as compared with those to which the head is applied by seaming or by another jointing system, the substantial advantage of a higher safety against leakage of the contents which may be also dangerous. The one-piece container exhibits, in respect of the other mentioned one, besides the abovesaid functional advantage, also a lesser material scrap during machining. Said advantages become even more remarkable in respect of containers having joints also in the wall and/or on the bottom.

As far as the manufacturing processes are concerned, it is known that the metal pressure containers cited hereinabove, in particular for those uses as aerosol dispensers, are at present generally obtained by manufacturing at first a cylinder with the desired wall thickness in one single piece with a concave dished bottom. The upper wall is then subjected to a later simple beading or tapering operation, according to whether a container of the type with jointed head or of the one-piece type is to be obtained, both types having, in their final form, a narrow beaded opening for the application of the valve after the filling.

The above-cited cylinder can be manufactured according to various technologies, but mainly by backward extrusion technology and deep drawing and stretching technology.

In the former case, the cylinder is manufactured in one single operative step, followed however, in the most up-to-date processes, by a sizing operation with slight stretching and dishing of the bottom in a drawbench.

Extrusion technology is profitably utilized for easily workable metal materials, such as for example aluminum, while it is not employable for the forming of other materials, such as for example the aluminum alloy known as 3004 H 19, due to the great technical difficulties connected with the obtainment of low thicknesses, as well as for productivity reasons (number of pieces produced per unit time).

The latter type of technology, considered as more advanced, is substantially based on a blanking and deep drawing step—which generally occurs in a double-acting and multiple die press fed with sheet metal—and on a stretching step forming the cylindrical cup in a drawbench the punch of which, suitably shaped, forces said cup through two or three reciprocally spaced gauged rings, having slightly decreasing inside diameters: in this manner the cup wall is remarkably lengthened by stretching, with consequent reduction of the thickness, which results to be very well gauged to the desired wall sizes of the cylinder.

For both abovesaid types of technologies there are also envisaged, from the mechanical viewpoint, a trimming operation at a constant height of the cylinder, and a slight shaping of its upper edge for the subsequent application of the head.

When one-piece type containers are to be obtained, it is possible to combine the cylinder extrusion operation with the tapering operation of the cylinder head, owing to the fact that, for being worked according to said technology metal materials are destined—for the reasons already explained—which are endowed with good formability characteristics and which, at the conclusion of the forming operation on the extruder, do not exhibit such hardening as to render the tapering operation difficult or impossible.

Conversely, said combination has not yet been realized for the technology according to which the cylinder is manufactured by deep drawing and stretching in a drawbench and which imparts to the cylinder walls, particularly to those with a small thickness, considerable strain-hardening, which render very difficult the successive forming operations, especially for metal materials which, due to their structural and physical-mechanical properties, are particularly sensible to strain-hardening by stretching.

OBJECTS OF THE INVENTION

It is an object of the present invention to provide a process for obtaining a unitary hollow metal body with a concave dished bottom and a dome-shaped, preferably hemispherical or ogival, head provided with a beaded opening, said the unitary bodies being characterized in that they are manufactured with very thin side walls having a high strain-hardening degree along with high mechanical characteristics.

It is another object of this invention to provide a process for obtaining metal unitary bodies like the ones described hereinbefore, which are lighter than the ones obtainable by the conventional processes of the art, though having equal mechanical performances.

SUMMARY OF THE INVENTION

These and other objects, which will more clearly appear to those skilled in the art, are achieved, according to the present invention, by combining the known technology for manufacturing the cylinder by deep drawing and stretching in a drawbench with technology for tapering the cylinder head based on several consecutive tapering steps of said head, optionally by integrating said process with a heating essentially limited to the cylinder upper portion which is to be subjected to the tapering operation, such heating being carried out between the stretching operation and the tapering operation. Said tapering technology for consecutive tapering steps integrated with the cited heating step is absolutely necessary in order to obtain a finished unitary body free from working defects.

Figure 1:
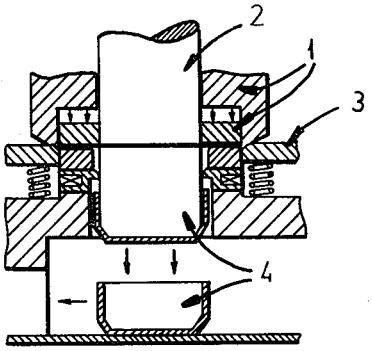
FIG. 1 is a vertical section through a deep-drawing apparatus for carrying out the initial cup formation according to the present invention.
Figure 2:
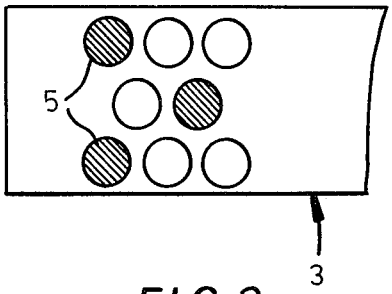
FIG. 2 is a plan view showing the pattern of the die cutting of a plurality of such cups from a sheet metal workpiece.
Figure 3:
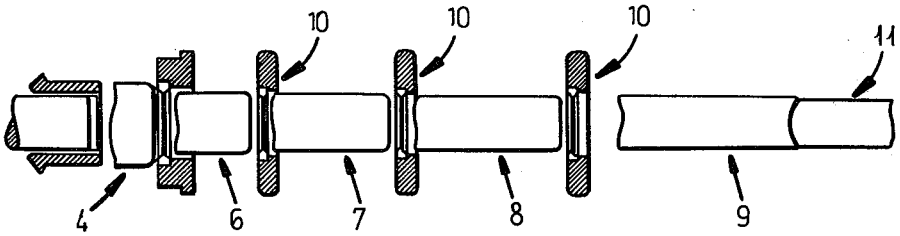
FIG. 3 is a plan view illustrating successive steps in the formation of the elongated sonder.

According to a preferred, but non-exclusive embodiment of the present invention, the process is conducted by utilizing an automatized production line comprising the operative steps—carried out by means of machines and apparatuses known in the art—which are briefly described hereinbelow in their succession and combination, with reference to the figures of the drawings being an integrant part of the present description:

(a)—feeding a metal plate, by unwinding from a roll, to the vertical double action press for blanking and deep drawing with a multiple die: by this operation the cutting of the discs and the deep drawing thereof in the form of cups is effected as shown in FIG. 1, wherein 1 is the blanking punch and holding-down clamp, 2 is the deep drawing punch, 3 the metal sheet, and 4 the cup obtained. By the multiple die it is possible to manufacture more cups simultaneously, as schematically shown, for illustrative purposes, for a triple die, in FIG. 2, wherein 5 are the discs which are cut and contemporaneously deep drawn from metal plate 3;

(b)—feeding cups 4 to a three-ring horizontal press-drawbench for deep redrawing and stretching: the shape variation of the cup, till assuming the shape of a thin wall elongated cylinder, are shown in FIG. 3, wherein 4 is the cup, 6 the deep redrawn cup, 7, 8 and 9 the three drawing and stretching runs through the three rings 10, and 11 is the operation of concave dishing the bottom by means of a counterpiston;

(c)—trimming, according to the conventional technique, the cylindrical enbloc bodies with dished bottom 9 at the desired constant height;

(d)—degreasing-pickling from the lubricants utilized in the preceding mechanical operations;

(e)—heating the heads of the cylindrical enbloc bodies, mounted on a conveyor chain, with combustible gas flames, heating being substantially limited to the zone to be tapered. To correctly effect heating, both number and intensity of the flames are previously adjusted as a function of the conveying chain speed, in order that the temperature attained by the cylinders' heads may be sufficient to render the material suited to the successive tapering and beading mechanical operations and, furthermore, to prevent the cylinders' zone, which must retain its cylindrical shape during said tapering operation, from suffering any considerable decay in its mechanical properties. To this purpose the process is controlled by periodically checking the temperature of the concerned zones by means of contact thermometers or other technically equivalent devices.

Figure 4:
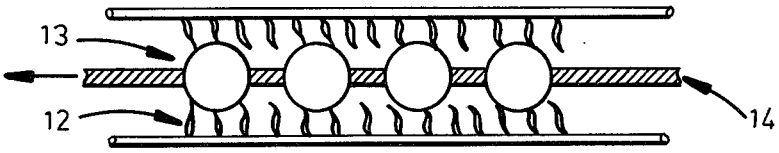
FIG. 4 is a plan view which shows the heating of the cylindrical portions of the bodies formed in FIGS. 1 and 3.

Heating operation is schematically shown in FIG. 4, wherein 12 is the gas flames, 13 indicates cylinder heads 9 being heated, and 14 is the conveying chain.

The heating operation may be carried out according to many other technically equivalent methods as regards the effects, such as, for example, with particular types of gas furnaces, with induction furnaces or with electrical resistance furnaces.

Figure 5:
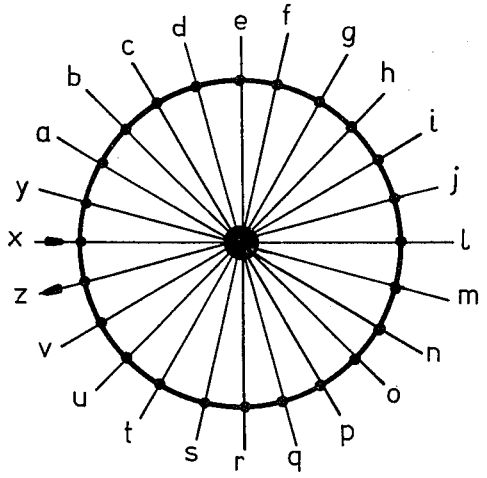
FIG. 5 is a diagram illustrative of the present invention.
Figure 6:
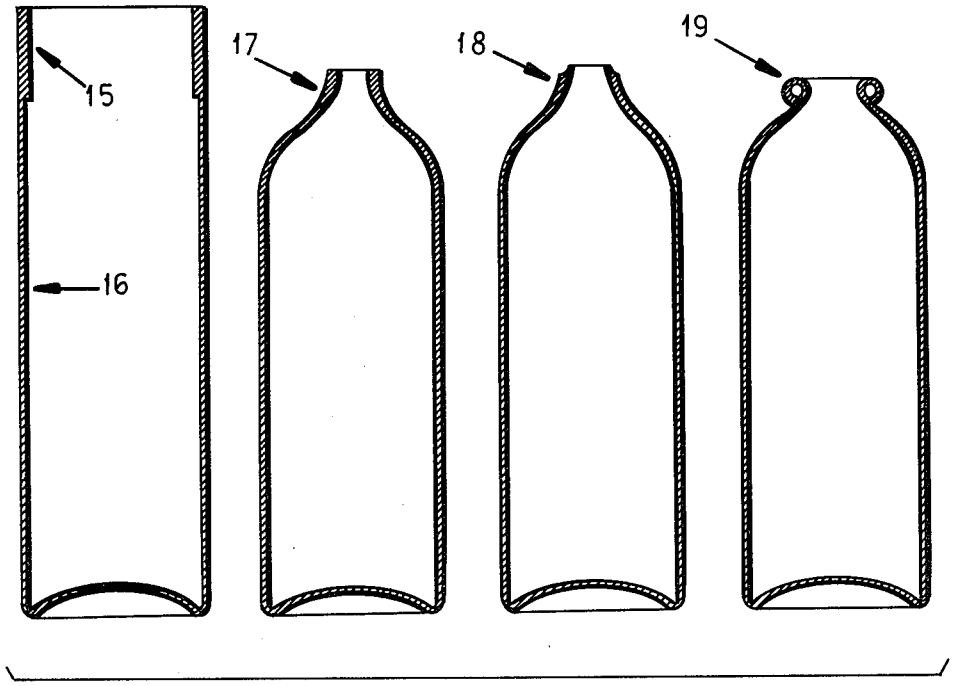
FIG. 6 is a vertical elevational view illustrating the depths in the formation of the head and neck of the container of the invention.

Heating localization may be optionally more rigidly controlled by providing, if necessary, a suitable cooling of the cylinders' portion not to be tapered, for example by means of a compressed air jet;

(f)—internal and external painting, and printing of the wordings;

(g)—forming of the cylinder head in an automatic tapering machine, with circular geometry and motion, having, according to the present invention, 24 operative stations, in which machine the desired aesthetical functional shape, generally ogival or hemispherical, with beaded opening, is imparted to the upper cylinder portion. The tapering machine is schematically shown in FIG. 5, wherein x and y respectively indicate the loading and lubrication stations, letters a to s indicate the eighteen stations for as many successive tapering operations with dies, in which, at every die run, a shape tapering with individual size reductions of the order of 2 to 4 mm are obtained, the three letters t, u,v indicate the rotating spindles respectively for the neck turning and relevant beading and for the final spot-facing of the opening edge; finally letter z indicates the unloading station. FIG. 6 schematically shows the shapes gradually imparted to the cylinder head after the tapering steps described hereinbefore. In said figure, 15 is the head to be tapered, while 16 is the thin wall that shall retain its sizes unchanged, 17 is the cylinder head with neck after the last die, 18 indicates the neck turning operation and 19 the beading and spot-facing operation: last operation is carried out to impart a perfect flatness to the opening for the purposes of a safe application of the valve after filling.

EXAMPLE

The process object of the present invention will be even better comprehended on the basis of the example described hereinbelow for merely illustrative and not limitative purposes, and is referred to two enbloc bodies having outside diameters of 53 and 74 mm respectively.

Making reference to the description of the above-cited preferred embodiment and to the attached figures, the sheet in roll utilized was made of an aluminium alloy known under the item 3004 H 19. The feeding speed was adjusted according to the speed of the triple die vertical press, which cut and deep drew, so providing the cups to be conveyed to the drawbench, where they underwent re-drawing and three cold drawings: the drawbench punch was shaped in such manner as to impart to the cylinder end portion to be subjected to the tapering operation a slightly higher thickness than the thin one of the remaining wall portion. The main size parameters regarding the said deep drawing and stretching operations are recorded in Table 1. The tabled values refer to the two enbloc bodies with 53 and 74 mm $\phi$ respectively.

TABLE 1

| Parameters | Enbloc type 53 mm | Enbloc type 74 mm |
|---|---|---|
| | Sizes, mm | |
| Starting sheet thickness | 0.6 | 0.8 |
| Cut disc diameter | 147.2 | 208 |
| Cup diamet.er | 88.3 | 125 |
| Cup height | 39.3 | 55.3 |
| Diameter of the re-drawn body | 53.5. | 75.5 |
| Height of the re-drawn body | 87.8 | 124.4 |
| Height after cold drawing | 1.0 | 312 |
| Thin wall thickness | 0.23 | 0.30 |
| Bottom thickness | 0.6 | 0.8 |
| Height of finished enbloc body | 175 | 287 |
| Diameter of finished opening | 25.4 | 25.4 |

Heating was effected between the stretching and the tapering operation, and precisely after degreasing-pickling and prior to painting; during such heating, the temperature reached by the enbloc bodies in the hottest portion of the extreme upper rim was of 320°–350° C. The tapering operation was substantially conducted as already illustrated in the preferred embodiment, with a number of tapering in die respectively of 12 and 18 for the two mentioned enbloc bodies, the opening heights and diameters thereof, in the finished state, are indicated in the above-cited Table 1.

Finally, Table 2 shows the weight values of the enbloc bodies respectively obtained by means of the known extrusion process (completed by gauging), indicated in Table 2 as Proc. E, and by means of the extrusion and stretching process forming the object of this invention and as exemplified hereinbefore, indicated in Table 2 as Proc. I & S.

The sizes of the enbloc bodies indicated in the cited Table represent the diameter multiplied by the height, expressed in mm. The enbloc bodies manufactured according to the two process types are compared on the basis of equal resistance to the internal operating pressures.

TABLE 2

| Sizes of enbloc bodies | Weights in g of finished enbloc bodies Proc. E | Proc. I & S |
|---|---|---|
| 53 × 175 | 35 | 26 |
| 74 × 287 | 88 | 68 |
| Material | Aluminium 99.9 | Aloy 3004 H 19 |

The data reported on Table 2 clearly show the advantages of metal material saving achieved with the enbloc bodies manufactured by the process object of this invention and according to the objects thereof.

The present invention, as illustrated in the above description and attached drawings, is susceptible of modifications and variants all falling within the scope of the inventive principle, and the process and product details may be replaced by other technically equivalent elements.

I claim:

1. A process for manufacturing a one-piece hollow body of an aluminum alloy, for use mainly as a pressure container, consisting of a cylindrical body having a concave dished bottom and of a dome-shaped head, said process comprising the steps of:

deep drawing and stretching said cylindrical body from an aluminum alloy metal plate; and tapering said cylindrical body in a succession of dies, while subjecting the body to a thermal treatment capable of transforming the upper part of said cylindrical body into a dome-shaped head with a beaded opening, said tapering operation being effected by at least 12 successive tapering steps, each of said tapering steps involving a diameter reduction not exceeding 4 mm, said aluminum alloy being alloy 3004 H 19, such alloy being suited to assume, during said deep drawing and stretching operations, high strain-hardening and consequent high mechanical characteristics.

2. The process defined in claim 1 wherein said diameter reduction is an amount ranging from 2 to 4 mm per tapering step.

3. The process defined in claim 2 wherein the cylindrical body is subjected to 12 to 18 tapering steps.

* * * * *